US005094319A

United States Patent [19]

Kobasic

[11] Patent Number: 5,094,319

[45] Date of Patent: Mar. 10, 1992

[54] LADDER STAND

[76] Inventor: Frank J. Kobasic, 427 Harwicke Rd., Springfield, Pa. 19064

[21] Appl. No.: 702,767

[22] Filed: May 16, 1991

[51] Int. Cl.[5] ..... E04C 7/16

[52] U.S. Cl. ..... 182/121; 182/129

[58] Field of Search ..... 182/121, 122, 120, 129; 248/210, 238

[56] References Cited

U.S. PATENT DOCUMENTS

| | | | |
|---|---|---|---|
| 794,729 | 7/1905 | McDonnall | 182/122 |
| 2,518,107 | 8/1950 | Wilson | 182/129 |
| 3,503,468 | 3/1970 | Taylor | 182/121 |
| 4,241,807 | 12/1980 | McKenna | 182/121 |
| 4,425,985 | 1/1984 | Geisel | 182/121 |
| 4,482,030 | 11/1984 | Lincourt | 182/121 |
| 4,586,586 | 5/1986 | Canals | 182/122 |
| 4,618,030 | 10/1986 | Campbell | 182/121 |
| 4,646,878 | 3/1987 | Moyer | 182/121 |

FOREIGN PATENT DOCUMENTS

| | | | |
|---|---|---|---|
| 1362063 | 7/1974 | United Kingdom | 182/121 |

*Primary Examiner*—Reinaldo P. Machado
*Attorney, Agent, or Firm*—Eugene E. Renz, Jr.

[57] ABSTRACT

A ladder stand device for use with conventional ladders comprising a pair of spaced apart side channels aligned to be placed inward from the stiles of a ladder and a bottom step and a top shelf spaced from one another by the distance between every other rung on the ladder. The step and shelf each are pivotally mounted on the pair of channels near opposite terminals end thereof. The step and shelf each have rung engaging locking tabs for engaging a rung, with each lock tab combining with the channels to prevent movement thereof transverse to the ladder stiles. The step further including a hinge for adjusting positioning the step in a storage position parallel to the channels and a rung engaging position for use as a step. The shelf has a padded front side for engagement with a person standing on the step in the rung engaging position. The shelf further has a latch for adjustably positioning the shelf in a storage position parallel to the channels.

11 Claims, 2 Drawing Sheets

LADDER STAND

FIELD OF THE INVENTION

The present invention relates to a stand for use with a ladder, and more particularly to a stand which is attached to a ladder for use by persons spending a relatively long time on the ladder.

BACKGROUND OF THE INVENTION

Stands for use with ladders have been of interest for almost as long as ladders have existed. Ladders, whether self standing or designed to lean against a structure, have certain features which must be compromised in view of practical considerations. For example, a longer ladder would ideally be better but if the ladder is too long it is difficult to move from place to place or to find an appropriate storage place. Similarly, a sturdy ladder is more desirable than a flimsy one, particularly, when full sized adults with heavy gear are using the ladder. Still heavy ladders are difficult to maneuver and to move about from place to place.

Less obvious but equally important are the limitations and compromises which go into the selection of the rungs of the ladders. Specifically, round ladders rungs are easier to manufacture and provide adequate support for the ladder, but they are hard on the users feet as they provide a thin line where the user's weight is focused. Flat rungs, even those which are only flat on top, provide a greater area over which the user's weight is spread. However, the relief provided by this additional expense and weight is minimal when the ladder is being used over a long period of time. Particularly, when painting and other labor intensive efforts are concerned, flat and round ladder rungs all cause discomfort and inconvenience to the user.

Platforms have been provided for ladders such as the support platform shown in U.S. Pat. No. 4,482,030 to Lincourt. The Lincourt device functions by hanging on one rung and providing a platform on the rung immediately below. The platform provides increased space for the user's foot or feet.

A similar device as shown in U.S. Pat. No. 4,425,985 to Geisel. In that patent, a platform is provided for standing wherein the platform extends in from the rung. Moyer, U.S. Pat. No. 4,646,878, provides a design wherein the portable step extends out from the ladder. In both of these patents, an upper portion hooks over the rung immediately above the step and do in fact increase the amount of standing area for the user.

In Wilson, U.S. Pat. No. 2,518,107, a shin shield is disclosed for step ladders. This design recognizes that the rung above the rung on which one stands can be provided with a cushion to ease the contact which takes place with that rung or step when it is used to brace ones self sufficiently to free both hands for work. To other designs for use with ladders are described in British patents to Wentworth, British Patent No. 1,362,063 and Lodge, British Patent No. 2,046,825. Both of these patents relate to devices which attach to two consecutive separate rungs of the ladder.

Nevertheless, there presently does not exist a simple and effective method for improving the efficiency and comfort of a ladder. Accordingly, it is an object of this invention to provide a device for use with a ladder, which substantially decreases the discomfort encountered in using ladders.

Another object of this invention is to provide a device which can be easily carried in one hand and placed at the appropriate position on a ladder for use in improved comfort and efficiency.

Yet another object of the present invention is to provide a ladder stand which not only prevents discomfort from long periods of standing on rungs of the ladder but which protects the user of the device from contact with the next rung up from the stand.

Other objects will appear hereinafter.

SUMMARY OF THE INVENTION

It has now been discovered that the above and other objects of the present invention may be accomplished in the following manner. Specifically, the present comprises a ladder stand device for use with conventional ladders and is designed to be placed inside of the stiles of a ladder and attached to two rungs of the ladder while leaving an intermediate rung in between those to which the device is attached.

The present invention comprises a ladder stand device which includes a pair of spaced apart side channels which are aligned to be placed parallel to and inside the stiles of the ladder. Both a bottom step and a top shelf are spaced from one another from the distance between every other rung of ladders and are pivotally mounted to the pair of channels near opposite terminal ends thereof. The step and the shelf each have rung engaging lock means for engaging the appropriate rung on the ladder. Each lock means combines with the channels to prevent movement of the step and shelf in a direction transverse to the ladder stiles.

The step means further includes hinge means for moving the step between a storage position parallel to the channels and a rung engaging position for use by a user. The shelf includes a padded front side for engagement with a user standing on the step in a rung engaging position. The shelf also includes latch means for adjustably positioning the shelf in a storage position parallel to the channels or in a rung engaging position in a generally horizontally plane.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
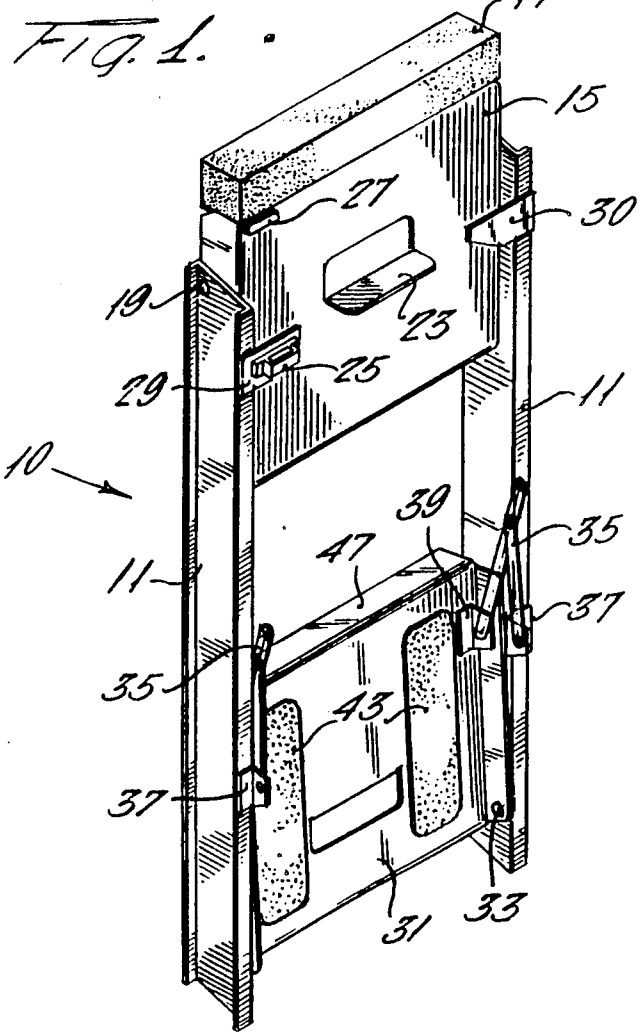
FIG. 1 is a perspective view of the preferred embodiment of the present invention, shown in a storage or transportation mode.

The ladder stand device of the present invention, shown generally by reference numeral 10 in FIG. 1, is designed for use in conventional ladders. The device includes a pair of channels 11 which are spaced apart and parallel to one another. Each channel 11 has side rails 13 for strength and stability and those side rails 13 extend away from the space between channels 11 so as to present the smooth face of channel 11 in an inwardly facing direction.

At the upper terminal end of channels 11, a tray shelf 15 is mounted. Tray 15 includes a knee pad 17 and is mounted to side channels 11 by a pivot fastener 19, such as a rivet, bolt or the like. Shelf 15 has a ridge 21 extending around the outer periphery thereof in an upward direction, to serve as a retaining edge when paint cans, tools and the like are placed on the tray 15. Knee pad 17 is fastened to the portion of the ridge 21 closest to the front of the ladder stand device.

Extending down from the tray 15 is ridge engagement locking tab 23. Locking tab 23 is spaced from the junction of channel 11 and shelf 15 by sufficient distance to permit engagement with a rung of a ladder. Locking tab 23 preferably extends vertically down from shelf 15 by a distance greater than the center or diameter of any flat, round or semi-round ladder rung.

Figure 2:
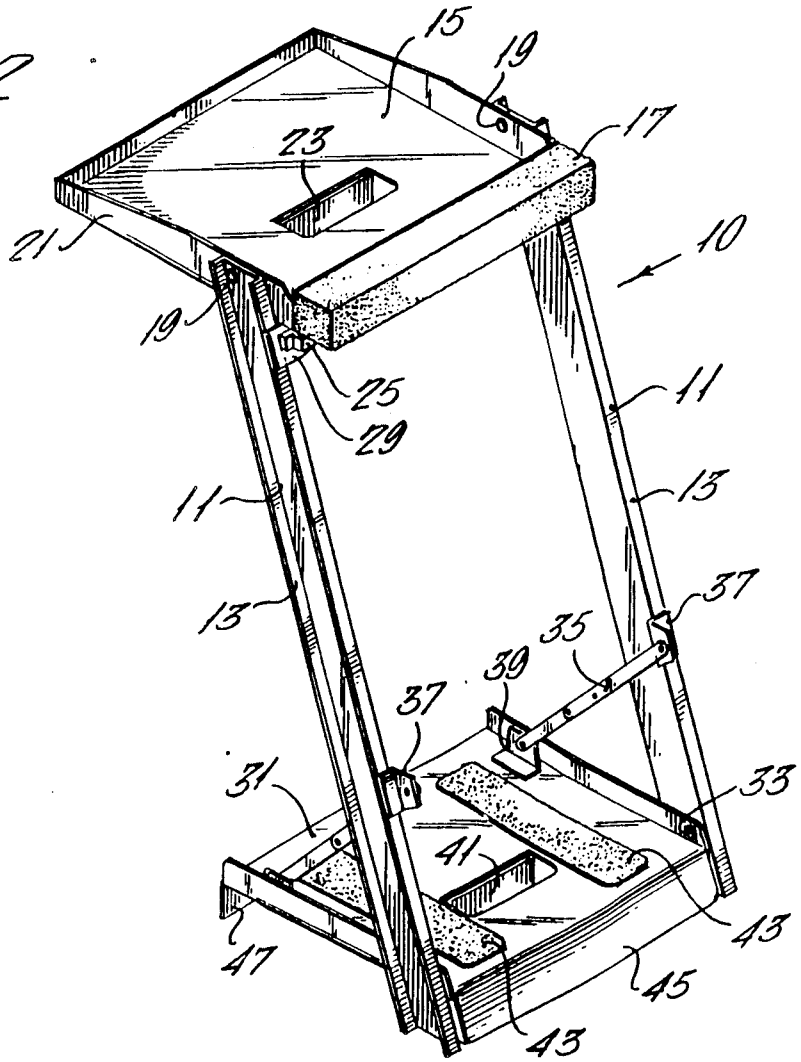
FIG. 2 is a perspective view of the device of FIG. 1, shown in its expanded or operating condition.

In the storage position, the shelf 15 is located between channels 11, with the knee pad extending vertically upward. For use, the tray 15 is placed in the operating position shown in FIG. 2 by rotating tray 15 about pivot 19 to the position shown. The ladder stand can be carried in its operating position because tray 15 is held in position by a magnet 25 which cooperates with a magnetically active metal 27. Magnet 25 is mounted on a gusset or positioning bracket 29 and is aligned to interact with the magnetically active metal 27 when moved to the in use position. The ladder stand is preferably made from aluminum and for that reason it is necessary to add the magnetically active surface 27 for engagement with magnet 25.

A similar gusset 30 is located on the other channel, without a magnet. The pair of gussets 29 and 30 serve to align and limit the movement of tray 15 in the storage position shown in FIG. 1 and serve as stop means when the tray is in the operating position shown in FIG. 2. The additional support from gussets 29 and 30 provide a stable surface and the gussets 29 and 30 take some of the weight of the individual when the user leans on pad 17.

Positioned at the other terminal end of channel 11 is a step 31. Step 31 is mounted with pivot 33 to permit movement from a storage position shown in FIG. 1 to the in use position shown in FIG. 2. Step 31 is also mounted to channels 11 with a ladder spreader hinge 35. Hinge 35 is attached to channel 11 with angle bracket 37 and attached to the floor of the step 31 with angle bracket 39. Step 31 has a rung engagement lock 41 of the same size and type as rung engagement locking tab 23 of tray 15. Tab 41 also extends down over 50% of the thickness of the ladder rung. In a preferred embodiment, the step 31 includes foot grips 43. Locking tab 41 extends down from the surface of step 31 as does the tapered front edge 45 which is flush with the ridge 13 of channel. Back ridge 47 also extends down and functions as a hand grip when the step 31 is in the storage position shown in FIG. 1.

Figure 3:
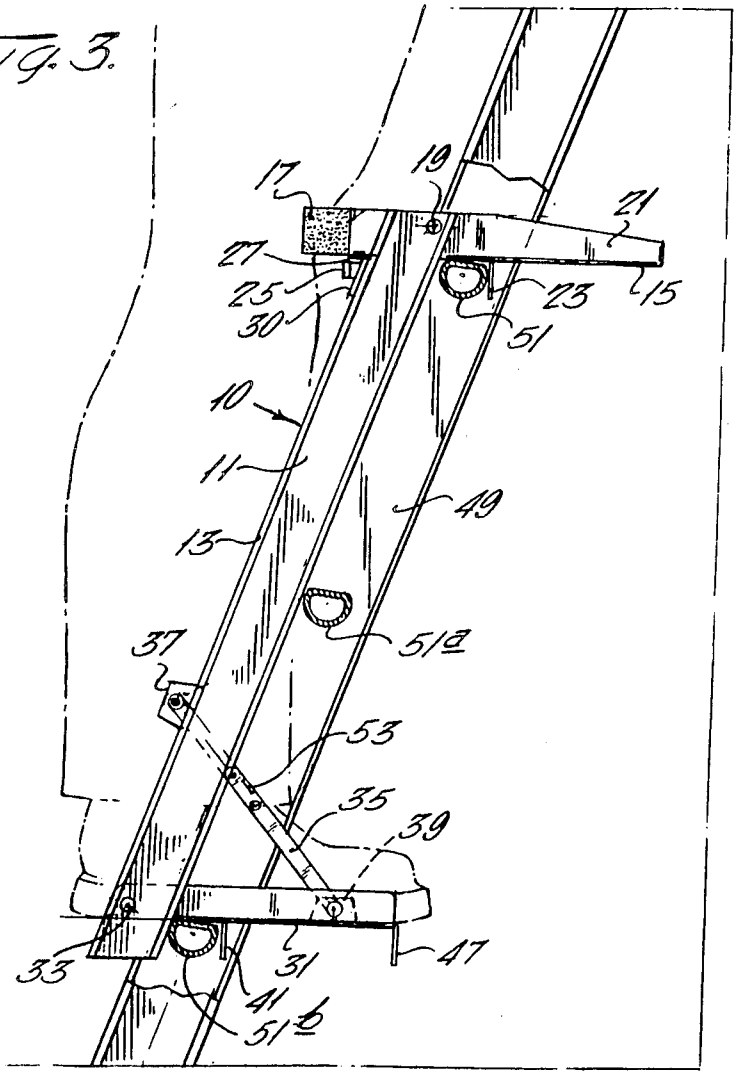
FIG. 3 is a side elevational view of the device shown in FIGS. 1 and 2, in operating relationship with a ladder in partial section.
Figure 4:
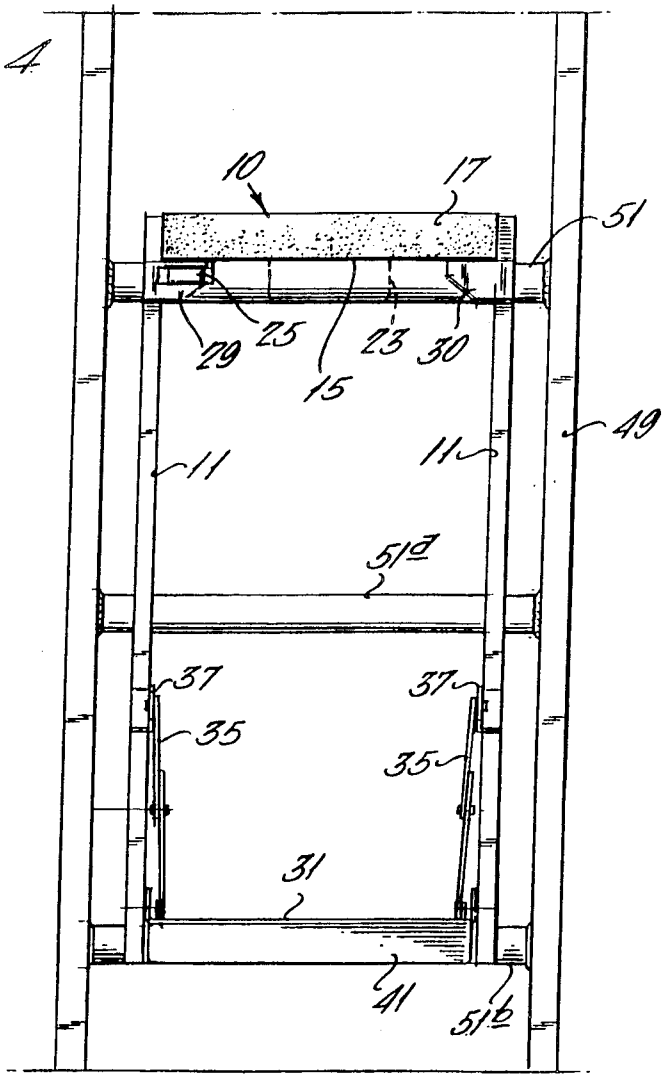
FIG. 4 is a front view of the device shown in FIGS. 1, 2 and 3.

Shown in FIGS. 3 and 4 is the device of this invention in combination with a ladder. The ladder stiles or side rails 49 are spaced apart from one another by rungs 51. The present invention is admirably suitable for use on any commercial ladder. Step ladders and other shorter ladders have parallel stiles or side rails 49. Other ladders such as extension ladders have stiles which taper inward from a relatively large distance to a more narrower dimension. The device of the present invention is designed to fit between the stiles of any commercially available ladder, even those which taper inwardly.

As can be seen in FIGS. 3 and 4, the shelf or tray 15 fits over a top rung 51 and the step 31 fits over a rung **51*b* which is separated from rung 51 by an intermediate rung 51*a*. This separation of the tray 15 and step 31, so that every other rung is engaged, is an important feature of the present invention. First, as can be seen in FIG. 3, a person standing on shelf 31, shown in dot and dash lines, and pressing his or her leg into pad 17 will provide excellent support for the person since pad 17 is aligned vertically and almost directly over the ball of the foot of the person. Thus, the weight of the person is not shifted excessively forward, even though ladders typically are designed to be inclined at an angle of about 72 to about 74° with respect to the ground surface. Another advantage of such an alignment is that intermediate rung 51*a* is now spaced from the person standing on step 31 and leaning on knee pad 17. The person is thus prevented from bruising or bumping his or her shin on the intermediate rung 51*a***, at least preventing a painful incident and possibly preventing a serious accident.

Almost all commercially available ladders have rungs which are spaced by twelve (12) inches. Accordingly, the tray 15 is separated from the step 31 by twenty four inches in order to engage every other rung on the ladders, as shown on FIGS. 3 and 4. The rung engagement locking tab 23 for tray 15 and the rung engagement locking tab 41 for step 31 extend on the building side of rungs 51 and **51*b*. Channel 11 is on the operator's side of rungs 51 and 51*b*. Thus, both tray 15 and step 31 are prevented from moving in a direction which is transverse to the stiles 49** of the ladder. The device is extremely safe and is comfortable for use over extended period of time.

The ladder spreader hinge 35 includes the detent 53, shown in FIG. 3, for locking the hinge 35 in the open position and provide additional stability to step 31. Every feature of the invention is focused on comfort and stability. For the first time, a ladder stand device is available which is universally applicable, functions simply and effectively without complicated mechanisms and hooks, and which provides a base of operation for long periods of time on all commercial ladders at any height.

While particular embodiments of the present invention have been illustrated and described herein, the description is not intended to limit the invention. Changes and modifications may be made therein within the scope of the following claims.

What is claimed is:

1. A ladder stand device for use with conventional ladders comprising:

a pair of spaced apart side channels aligned to be placed inward from the stiles of a ladder;

a bottom step and a top shelf spaced from one another by the distance between every other rung on said ladder, said step and shelf each being pivotally mounted to said pair of channels near opposite terminals end thereof, said step and shelf each having rung engaging lock means for engaging a rung, each lock means combining with said channels during said engagement to prevent movement thereof transverse to said ladder stiles;

said step means further including hinge means for adjustably positioning said step in a storage position parallel to said channels and a rung engaging position for use as a step; and said shelf means having a padded front side for engagement with the user standing on step in said rung engaging position, said shelf further having latch means for adjustably positioning said shelf in a storage position parallel to said channels.

2. The device of claim 1, wherein said bottom step includes foot grip means for providing additional traction for the user.

3. The device of claim 1 wherein said rung engaging lock means includes a rung engagement locking tab extending down from each of said step and said shelf.

4. The device of claim 3 wherein said tab extends vertically down from said step and said shelf by a distance greater than the center of any flat, round or semi round ladder rung.

5. The device of claim 1 wherein said shelf means includes means for adjustably holding said shelf in a rung engaging position.

6. The device of claim 1 wherein said shelf includes a user engaging end, said end having cushion means thereon for providing padding against which the user can rest.

7. The device of claim 1 wherein said step includes locking means for restraining said step in a rung engaging position.

8. A ladder stand device for use with conventional ladders comprising:

a pair of spaced apart side channels aligned to be placed inward from the stiles of a ladder;

a bottom step and a top shelf spaced from one another by the distance between every other rung on said ladder, said step and shelf each being pivotally mounted to said pair of channels near opposite terminals end thereof, said step and shelf each having rung engaging locking tabs extending down vertically from said shelf and step by a distance greater than the center for engaging a rung, each lock means combining with said channels during said engagement to prevent movement thereof transverse to said ladder stiles;

said step means further including hinge means for adjustably positioning said step in a storage position parallel to said channels and a rung engaging position for use as a step; and means having a front side with cushion means said shelf thereon for engagement with the user standing on step in said rung engaging position, said shelf further having latch means for adjustably positioning said shelf in a storage position parallel to said channels.

9. The device of claim 8, wherein said bottom step includes foot grip means for providing additional traction for the user.

10. The device of claim 1 wherein one of said side channels and said shelf means include magnet means for adjustably holding said shelf in a rung engaging position.

11. The device of claim 8 wherein said step includes locking means for restraining said step in a rung engaging position.

* * * * *